US008020316B2

(12) United States Patent
Nawrot et al.

(10) Patent No.: US 8,020,316 B2
(45) Date of Patent: Sep. 20, 2011

(54) WASHING HOUSEHOLD DEVICE, IN PARTICULAR A CLOTHES DRYER

(75) Inventors: Thomas Nawrot, Berlin (DE); Hans-Werner Stahn, Berlin (DE); Andreas Stolze, Falkensee (DE); Andreas Ziemann, Potsdam (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 603 days.

(21) Appl. No.: 11/920,715

(22) PCT Filed: Feb. 23, 2006

(86) PCT No.: PCT/EP2006/060225

§ 371 (c)(1), (2), (4) Date: Nov. 16, 2007

(87) PCT Pub. No.: WO2006/122840

PCT Pub. Date: Nov. 23, 2006

(65) Prior Publication Data

US 2009/0113747 A1 May 7, 2009

(30) Foreign Application Priority Data

May 20, 2005 (DE) ..... 10 2005 023 446

(51) Int. Cl.
*F26B 11/00* (2006.01)

(52) U.S. Cl. ..... 34/603; 34/242; 34/72; 34/610; 34/595; 705/14; 68/19.2; 68/18 C; 15/305; 15/228; 432/110; 432/117; 134/6; 219/757

(58) Field of Classification Search ..... 34/603, 34/242, 72, 610, 595; 219/757; 705/14; 68/19.2, 18 C; 432/110, 117; 134/6
See application file for complete search history.

(56) References Cited

U.S. PATENT DOCUMENTS

| | | | | | |
|---|---|---|---|---|---|
| 1,443,367 | A | * | 1/1923 | Kennedy | 99/355 |
| 1,904,153 | A | * | 4/1933 | Lucke | 110/348 |
| 1,943,053 | A | * | 1/1934 | Bolsset | 126/116 R |
| 1,984,315 | A | * | 12/1934 | Morris | 432/110 |
| 2,024,453 | A | * | 12/1935 | Vogel-Jorgensen | 432/117 |
| 2,126,778 | A | * | 8/1938 | Horton | 101/157 |
| 2,144,157 | A | * | 1/1939 | Jorgenson | 68/19.2 |
| 2,165,487 | A | * | 7/1939 | Johnson | 68/18 C |
| 2,166,548 | A | * | 7/1939 | Janssen | 66/125 A |
| 2,237,256 | A | * | 4/1941 | Finnegan | 62/63 |
| 2,284,905 | A | * | 6/1942 | Jackson | 34/72 |
| 2,316,459 | A | * | 4/1943 | Schmidt et al. | 34/92 |
| 2,333,850 | A | * | 11/1943 | Dunkley | 34/284 |

(Continued)

FOREIGN PATENT DOCUMENTS

CH 671346 A * 8/1989

(Continued)

OTHER PUBLICATIONS

International Search Report PCT/EP2006/060225.

*Primary Examiner* — Stephen M. Gravini
(74) *Attorney, Agent, or Firm* — James E. Howard; Andre Pallapies

(57) ABSTRACT

The invention relates to a washing household device, in particular to a clothes dryer, that includes an air-supply device which is arranged on a rear side area thereof and is provided with a closed self-contained cross-section flow channel.

25 Claims, 8 Drawing Sheets

U.S. PATENT DOCUMENTS

| | | | | | |
|---|---|---|---|---|---|
| 2,336,698 | A | * | 12/1943 | Morrill | 34/500 |
| 2,346,176 | A | * | 4/1944 | McAleer | 34/500 |
| 2,410,851 | A | * | 11/1946 | Welty | 432/66 |
| 2,437,899 | A | * | 3/1948 | Welty | 34/65 |
| 2,486,058 | A | * | 10/1949 | Patterson et al. | 34/82 |
| 2,521,712 | A | * | 9/1950 | Geldhof | 34/82 |
| 2,539,407 | A | * | 1/1951 | Dinley | 34/74 |
| 2,543,776 | A | * | 3/1951 | Greisen | 34/138 |
| 2,547,238 | A | * | 4/1951 | Tremblay | 34/603 |
| 2,585,105 | A | * | 2/1952 | Frank | 198/860.4 |
| 2,608,768 | A | * | 9/1952 | Noel | 34/570 |
| 2,634,510 | A | * | 4/1953 | Taylor | 34/406 |
| 2,639,681 | A | * | 5/1953 | Webb | 110/104 R |
| 2,645,863 | A | * | 7/1953 | Morrison | 34/239 |
| 2,663,044 | A | * | 12/1953 | Gilbert | 15/305 |
| 2,677,041 | A | * | 4/1954 | Oliver et al. | 392/381 |
| RE24,211 | E | * | 9/1956 | Zimmermann | 34/174 |
| 2,769,246 | A | * | 11/1956 | Shapter | 34/82 |
| 2,783,549 | A | * | 3/1957 | Young | 34/83 |
| 2,797,567 | A | * | 7/1957 | Sigurd | 68/16 |
| 2,798,304 | A | * | 7/1957 | Reiter | 34/91 |
| 2,798,306 | A | * | 7/1957 | Reiter | 34/609 |
| 2,798,307 | A | * | 7/1957 | Reiter | 34/610 |
| 2,828,550 | A | * | 4/1958 | Geldhof | 34/75 |
| 2,843,943 | A | * | 7/1958 | Geldhof et al. | 34/75 |
| 2,853,798 | A | * | 9/1958 | Morrison | 34/75 |
| 2,904,847 | A | * | 9/1959 | Burns | 209/238 |
| 2,920,399 | A | * | 1/1960 | Fry, Jr | 34/647 |
| 2,942,353 | A | * | 6/1960 | Barnett | 34/82 |
| 2,949,679 | A | * | 8/1960 | MacCracken et al. | 34/598 |
| 2,957,330 | A | * | 10/1960 | Cline | 68/20 |
| 2,958,138 | A | * | 11/1960 | Ashby | 34/601 |
| 3,000,108 | A | * | 9/1961 | Jones et al. | 34/607 |
| 3,015,893 | A | * | 1/1962 | McCreary | 34/646 |
| 3,028,682 | A | * | 4/1962 | Fleissner | 34/115 |
| 3,043,014 | A | * | 7/1962 | Loechl | 34/524 |
| 3,122,981 | A | * | 3/1964 | Ellis et al. | 396/579 |
| 3,134,583 | A | * | 5/1964 | Wilson | 432/162 |
| 3,140,161 | A | * | 7/1964 | Poynor et al. | 34/227 |
| 3,184,225 | A | * | 5/1965 | Wilson | 432/38 |
| 3,196,554 | A | * | 7/1965 | Smith | 34/557 |
| 3,206,950 | A | * | 9/1965 | Xeros | 68/12.09 |
| 3,254,427 | A | * | 6/1966 | Dorr | 34/546 |
| 3,257,735 | A | * | 6/1966 | Catallo | 26/81 |
| 3,261,107 | A | * | 7/1966 | Ponczek et al. | 34/99 |
| 3,270,434 | A | * | 9/1966 | Hackenberg et al. | 34/92 |
| 3,270,436 | A | * | 9/1966 | Fairgrieve | 34/131 |
| 3,292,350 | A | * | 12/1966 | Tasset | 56/1 |
| 3,293,772 | A | * | 12/1966 | Gottfried et al. | 34/92 |
| 3,295,930 | A | * | 1/1967 | Swanson et al. | 422/200 |
| 3,316,658 | A | * | 5/1967 | Strike | 34/126 |
| 3,333,346 | A | * | 8/1967 | Brucken | 34/131 |
| 3,345,756 | A | * | 10/1967 | Bryand et al. | 34/454 |
| 3,349,502 | A | * | 10/1967 | Kiefer | 34/216 |
| 3,359,648 | A | * | 12/1967 | Overly et al. | 34/654 |
| 3,394,470 | A | * | 7/1968 | Fleissner | 34/115 |
| 3,411,220 | A | * | 11/1968 | Fleissner | 34/115 |
| 3,445,902 | A | * | 5/1969 | Rosenberg et al. | 26/2 R |
| 3,475,832 | A | * | 11/1969 | Kuelling | 34/182 |
| 3,478,546 | A | * | 11/1969 | Serbin | 277/345 |
| 3,480,456 | A | * | 11/1969 | Forkner | 427/4 |
| 3,521,378 | A | * | 7/1970 | Fleissner | 34/115 |
| 3,543,415 | A | * | 12/1970 | Meyer | 34/130 |
| 3,585,733 | A | * | 6/1971 | Fleissner | 4/115 |
| 3,588,950 | A | * | 6/1971 | Marshall | 425/7 |
| 3,761,549 | A | * | 9/1973 | Marshall | 264/15 |
| 3,816,942 | A | * | 6/1974 | Smith | 34/242 |
| 3,910,757 | A | * | 10/1975 | Taylor et al. | 34/233 |
| 3,975,832 | A | * | 8/1976 | Mori et al. | 34/562 |
| 4,015,930 | A | * | 4/1977 | Grantham | 432/105 |
| 4,145,819 | A | * | 3/1979 | Fleissner | 34/68 |
| 4,197,448 | A | * | 4/1980 | Harigai | 392/384 |
| 4,207,686 | A | * | 6/1980 | Daily | 34/610 |
| 4,255,037 | A | * | 3/1981 | Meadows et al. | 396/574 |
| 4,380,126 | A | * | 4/1983 | Kinder | 34/86 |
| 4,489,455 | A | * | 12/1984 | Spendel | 8/158 |
| 4,489,574 | A | * | 12/1984 | Spendel | 68/16 |
| 4,507,080 | A | * | 3/1985 | Freze | 432/105 |
| 4,555,019 | A | * | 11/1985 | Spendel | 206/223 |
| 4,729,133 | A | * | 3/1988 | Wileman, III | 4/233 |
| 4,765,066 | A | * | 8/1988 | Yoon | 34/261 |
| 4,857,707 | A | | 8/1989 | Dall | |
| 4,974,339 | A | * | 12/1990 | Kawamura et al. | 34/73 |
| 4,989,347 | A | | 2/1991 | Kretchman | |
| 5,038,497 | A | * | 8/1991 | Pelequin | 34/622 |
| 5,062,219 | A | * | 11/1991 | Harris et al. | 34/606 |
| 5,083,704 | A | * | 1/1992 | Rounthwaite | 232/43.2 |
| 5,317,816 | A | * | 6/1994 | Kadakia | 34/603 |
| 5,477,623 | A | * | 12/1995 | Tomizawa et al. | 34/58 |
| 5,555,647 | A | * | 9/1996 | Torborg et al. | 34/601 |
| 5,560,120 | A | | 10/1996 | Swanson et al. | |
| 5,564,331 | A | * | 10/1996 | Song | 99/469 |
| 5,852,879 | A | * | 12/1998 | Schumaier | 34/80 |
| 5,899,005 | A | * | 5/1999 | Chen et al. | 34/528 |
| 5,965,164 | A | * | 10/1999 | Fuisz et al. | 424/489 |
| 6,006,445 | A | * | 12/1999 | Large | 34/609 |
| 6,098,310 | A | * | 8/2000 | Chen et al. | 34/475 |
| 6,141,887 | A | * | 11/2000 | Chen et al. | 34/475 |
| 6,195,912 | B1 | * | 3/2001 | Moon et al. | 34/577 |
| RE37,238 | E | * | 6/2001 | Song | 99/469 |
| 6,324,770 | B2 | * | 12/2001 | Moon et al. | 34/577 |
| 6,324,771 | B1 | * | 12/2001 | McAllister et al. | 34/595 |
| 6,663,306 | B2 | * | 12/2003 | Policicchio et al. | 401/138 |
| 6,669,391 | B2 | * | 12/2003 | Policicchio et al. | 401/270 |
| 6,671,977 | B2 | * | 1/2004 | Beaumont | 34/79 |
| 6,691,536 | B2 | * | 2/2004 | Severns et al. | 68/12.27 |
| 6,772,534 | B2 | * | 8/2004 | Gomes et al. | 34/330 |
| 6,814,519 | B2 | * | 11/2004 | Policicchio et al. | 401/139 |
| 6,829,845 | B2 | * | 12/2004 | Han et al. | 34/603 |
| 6,845,290 | B1 | * | 1/2005 | Wunderlin et al. | 700/208 |
| 6,854,911 | B2 | * | 2/2005 | Policicchio et al. | 401/138 |
| 6,898,951 | B2 | * | 5/2005 | Severns et al. | 68/5 C |
| 6,910,823 | B2 | * | 6/2005 | Policicchio et al. | 401/138 |
| 6,920,781 | B2 | * | 7/2005 | Olesen | 73/73 |
| 6,948,873 | B2 | * | 9/2005 | Policicchio et al. | 401/139 |
| 7,013,578 | B2 | * | 3/2006 | Wunderlin et al. | 34/528 |
| 7,093,377 | B2 | * | 8/2006 | Doh et al. | 34/596 |
| 7,114,266 | B2 | * | 10/2006 | Gomes et al. | 34/80 |
| 7,144,173 | B2 | * | 12/2006 | Policicchio et al. | 401/138 |
| 7,163,349 | B2 | * | 1/2007 | Policicchio et al. | 401/137 |
| 7,182,537 | B2 | * | 2/2007 | Policicchio et al. | 401/138 |
| 7,213,349 | B1 | * | 5/2007 | Brunner et al. | 34/86 |
| 7,257,905 | B2 | * | 8/2007 | Guinibert et al. | 34/82 |
| 7,275,400 | B2 | * | 10/2007 | Severns et al. | 68/18 F |
| 7,322,126 | B2 | * | 1/2008 | Beaulac | 34/554 |
| 7,406,780 | B2 | * | 8/2008 | Doh et al. | 34/606 |
| 7,478,486 | B2 | * | 1/2009 | Wunderlin et al. | 34/491 |
| 7,644,514 | B2 | * | 1/2010 | Heyder et al. | 34/595 |
| 7,662,745 | B2 | * | 2/2010 | Zhang et al. | 502/401 |
| 7,761,954 | B2 | * | 7/2010 | Ziegler et al. | 15/320 |
| 2001/0001349 | A1 | * | 5/2001 | Moon et al. | 34/577 |
| 2002/0023368 | A1 | * | 2/2002 | Beaumont | 34/79 |
| 2002/0133886 | A1 | * | 9/2002 | Severns et al. | 8/142 |
| 2002/0166573 | A1 | * | 11/2002 | Policicchio et al. | 134/6 |
| 2002/0168216 | A1 | * | 11/2002 | Policicchio et al. | 401/270 |
| 2003/0034050 | A1 | * | 2/2003 | Policicchio et al. | 134/6 |
| 2003/0095826 | A1 | * | 5/2003 | Policicchio et al. | 401/138 |
| 2003/0126709 | A1 | * | 7/2003 | Policicchio et al. | 15/228 |
| 2003/0126710 | A1 | * | 7/2003 | Policicchio et al. | 15/228 |
| 2003/0127108 | A1 | * | 7/2003 | Policicchio et al. | 134/6 |
| 2003/0133740 | A1 | * | 7/2003 | Policicchio et al. | 401/270 |
| 2003/0172546 | A1 | * | 9/2003 | Gomes et al. | 34/330 |
| 2004/0086320 | A1 | * | 5/2004 | Policicchio et al. | 401/138 |
| 2004/0129032 | A1 | * | 7/2004 | Severns et al. | 68/5 C |
| 2004/0163276 | A1 | * | 8/2004 | Han et al. | 34/603 |
| 2004/0187343 | A1 | * | 9/2004 | Beaumont | 34/544 |
| 2004/0200093 | A1 | * | 10/2004 | Wunderlin et al. | 34/606 |
| 2004/0226123 | A1 | * | 11/2004 | Policicchio et al. | 15/115 |
| 2004/0237333 | A1 | * | 12/2004 | Gomes et al. | 34/330 |
| 2005/0050644 | A1 | * | 3/2005 | Severns et al. | 8/115.51 |
| 2005/0076535 | A1 | * | 4/2005 | Guinibert et al. | 34/601 |
| 2005/0080520 | A1 | * | 4/2005 | Kline et al. | 701/1 |
| 2005/0137085 | A1 | * | 6/2005 | Zhang et al. | 502/402 |
| 2005/0166421 | A1 | * | 8/2005 | Doh et al. | 34/603 |
| 2005/0183208 | A1 | * | 8/2005 | Scheper et al. | 8/142 |
| 2005/0215459 | A1 | * | 9/2005 | Policicchio et al. | 510/438 |
| 2005/0264472 | A1 | * | 12/2005 | Rast | 345/30 |

| | | | | |
|---|---|---|---|---|
| 2006/0005418 | A1 * | 1/2006 | Kim | 34/108 |
| 2006/0041448 | A1 * | 2/2006 | Patterson et al. | 705/1 |
| 2006/0191161 | A1 * | 8/2006 | Wunderlin et al. | 34/562 |
| 2006/0236560 | A1 * | 10/2006 | Doh et al. | 34/596 |
| 2006/0242858 | A1 * | 11/2006 | Beaulac | 34/446 |
| 2006/0289533 | A1 * | 12/2006 | Park et al. | 219/757 |
| 2007/0016328 | A1 * | 1/2007 | Ziegler et al. | 700/245 |
| 2007/0101603 | A1 * | 5/2007 | Beaumont | 34/85 |
| 2007/0135785 | A1 * | 6/2007 | Qin et al. | 604/368 |
| 2007/0151119 | A1 * | 7/2007 | Heyder et al. | 34/601 |
| 2007/0227031 | A1 * | 10/2007 | Yoon | 34/242 |
| 2007/0255243 | A1 * | 11/2007 | Kaun et al. | 604/378 |
| 2008/0052951 | A1 * | 3/2008 | Beaulac | 34/549 |
| 2008/0052954 | A1 * | 3/2008 | Beaulac | 34/572 |
| 2008/0134458 | A1 * | 6/2008 | Ziegler et al. | 15/320 |
| 2008/0140255 | A1 * | 6/2008 | Ziegler et al. | 700/245 |
| 2008/0147026 | A1 * | 6/2008 | Qin et al. | 604/358 |
| 2008/0155768 | A1 * | 7/2008 | Ziegler et al. | 15/4 |
| 2008/0189973 | A1 * | 8/2008 | Dittmer et al. | 34/76 |
| 2008/0189974 | A1 * | 8/2008 | Dittmer et al. | 34/132 |
| 2009/0038175 | A1 * | 2/2009 | Ziemann | 34/218 |
| 2009/0050834 | A1 * | 2/2009 | Boise et al. | 251/320 |
| 2009/0050835 | A1 * | 2/2009 | Boise et al. | 251/320 |
| 2009/0090018 | A1 * | 4/2009 | Stein | 34/60 |
| 2009/0113747 | A1 * | 5/2009 | Nawrot et al. | 34/218 |
| 2009/0126218 | A1 * | 5/2009 | Dittmer et al. | 34/130 |
| 2009/0235555 | A1 * | 9/2009 | Jie Bo | 34/557 |
| 2009/0260256 | A1 * | 10/2009 | Beaulac | 34/528 |
| 2009/0292075 | A1 * | 11/2009 | Tamai et al. | 525/221 |
| 2009/0307923 | A1 * | 12/2009 | Hu | 34/218 |
| 2010/0071224 | A1 * | 3/2010 | Chung | 34/218 |
| 2010/0083531 | A1 * | 4/2010 | Hu | 34/565 |
| 2011/0041415 | A1 * | 2/2011 | Esposito | 52/12 |

FOREIGN PATENT DOCUMENTS

| | | | | |
|---|---|---|---|---|
| CH | 671346 | A5 * | 8/1989 | |
| DE | 3150040 | A1 * | 7/1982 | |
| DE | 3336398 | A1 * | 4/1985 | |
| DE | 3401040 | A1 * | 7/1985 | |
| DE | 3815321 | A1 * | 11/1989 | |
| DE | 4109444 | A1 * | 9/1992 | |
| DE | 19700065 | A1 * | 5/1998 | |
| DE | 19731033 | A1 * | 1/1999 | |
| DE | 19752167 | A1 * | 5/1999 | |
| DE | 19843990 | C1 * | 8/1999 | |
| DE | 100 01 702 | | 5/2001 | |
| DE | 10017804 | A1 * | 10/2001 | |
| EP | 442273 | A2 * | 8/1991 | |
| EP | 0 576 825 | | 1/1994 | |
| EP | 790031 | A1 * | 8/1997 | |
| EP | 898353 | A1 * | 2/1999 | |
| EP | 1018314 | A1 * | 7/2000 | |
| EP | 1555342 | A2 * | 7/2005 | |
| EP | 1 614 792 | | 1/2006 | |
| EP | 2107155 | A2 * | 10/2009 | |
| FR | 2782295 | A1 * | 2/2000 | |
| FR | 2790012 | A1 * | 8/2000 | |
| FR | 2877704 | A1 * | 5/2006 | |
| GB | 2063074 | A * | 6/1981 | |
| GB | 2 248 920 | | 4/1992 | |
| GB | 2 253 035 | | 8/1992 | |
| GB | 2253035 | A * | 8/1992 | |
| JP | 54161741 | A * | 12/1979 | |
| JP | 01288299 | A * | 11/1989 | |
| JP | 02295596 | A * | 12/1990 | |
| JP | 03251297 | A * | 11/1991 | |
| JP | 04028400 | A * | 1/1992 | |
| JP | 04300592 | A * | 10/1992 | |
| JP | 05007686 | A * | 1/1993 | |
| JP | 06000292 | A * | 1/1994 | |
| JP | 07039690 | A * | 2/1995 | |
| JP | 09094385 | A * | 4/1997 | |
| JP | 09094393 | A * | 4/1997 | |
| JP | 09108497 | A * | 4/1997 | |
| JP | 09149996 | A * | 6/1997 | |
| JP | 10005496 | A * | 1/1998 | |
| JP | 10179996 | A * | 7/1998 | |
| JP | 2000230780 | A * | 8/2000 | |
| JP | 2000325699 | A * | 11/2000 | |
| JP | 2001062192 | A * | 3/2001 | |
| JP | 2001170398 | A * | 6/2001 | |
| JP | 2002159789 | A * | 6/2002 | |
| JP | 2002233693 | A * | 8/2002 | |
| JP | 2003062398 | A * | 3/2003 | |
| JP | 2004121355 | A * | 4/2004 | |
| JP | 2005-58658 | | 3/2005 | |
| JP | 2006218274 | A * | 8/2006 | |
| JP | 2007330569 | A * | 12/2007 | |
| WO | WO 0004980 | A1 * | 2/2000 | |
| WO | WO 03038281 | A1 * | 5/2003 | |
| WO | WO 2004094738 | A1 * | 11/2004 | |

* cited by examiner

G - H

WASHING HOUSEHOLD DEVICE, IN PARTICULAR A CLOTHES DRYER

The present invention relates to a domestic appliance for the care of laundry items, in particular embodied as a laundry dryer. The domestic appliance comprises an air conveying device arranged in the area of the rear of the domestic appliance.

BACKGROUND OF THE INVENTION

In the case of known laundry dryers, relatively high energy losses occur during operation of the same, particularly in relation to metal parts of the clothes dryer. The energy consumption of domestic clothes dryers of this type is thereby often significantly increased. Additionally air transfer noise is radiated over large metal surfaces of the domestic clothes dryer, as a result of which considerable levels of noise develop. A disadvantage is also to be discerned in the case of known domestic clothes dryers in that relatively long drying times apply, also as a result of the inadequate air conveyance.

SUMMARY OF THE INVENTION

The object of the present invention is thus to create a domestic appliance for the care of laundry items having reduced energy consumption as well a relatively low noise development during operation. The object of the present invention is in particular to create a clothes dryer which in addition to low energy consumption and quiet operation, can also guarantee a reduction in drying times.

This object is achieved by a domestic appliance for the care of laundry items which has the features of the exemplary embodiments described herein.

A domestic appliance according to the invention for the care of laundry items has an air conveying device arranged in the area of the rear of the domestic appliance. The inventive domestic appliance is in particular embodied as a clothes dryer. An important idea behind the invention is that the air conveying device has a flow channel which is closed cross-sectionally, with the closed flow channel being advantageously embodied in two-part form, and is embodied as a wall area of the rear of the domestic appliance facing the outside of the domestic appliance, and an element of U-shaped cross section arranged on this wall area. By means of the inventive domestic appliance it is thus possible to achieve a marked reduction in energy consumption during operation, as well to guarantee very quiet operation. In particular then when the inventive domestic appliance is embodied as a clothes dryer, it is further also possible to achieve a reduction in the drying time for the laundry items contained in the clothes dryer. All the abovementioned advantages thus also enable a reduction in the cost of operating the domestic appliance.

The cross-sectionally closed flow channel preferably has open end areas.

A first open end area is advantageously connected to a heating device, with the second open end area preferably also being connected to a fan mechanism.

The fan mechanism can advantageously have a fan wheel, said fan wheel being arranged in a housing which has an opening which opens into the second open end area of the closed flow channel.

A seal is particularly advantageously arranged between the housing of the fan wheel and a cover covering at least the housing. By means of such an axial arrangement of a seal between the housing of the fan wheel and the cover covering at least this housing, it is possible to achieve a calming of the air between the wall area of the rear and the cover, thus also achieving an improved insulation effect. A reduction in vortex shedding can also be guaranteed, thereby attaining a marked reduction in noise development.

In a particularly preferred manner, the cover which covers the housing also covers the closed flow channel and the heating device. A reduction in noise development can herewith be achieved once again.

The seal between the housing of the fan wheel and the covering hood can in a preferable manner be arranged, and in particular glued, onto the peripheral area of the housing and/or on the cover. It can thereby be guaranteed that the seal can be arranged in a stable position, and fixed to the two objects to be sealed off from one another.

BRIEF DESCRIPTION OF THE DRAWINGS

It can be provided that the two open end areas of the closed flow channel are embodied opposite to each other, with the closed flow channel being arranged essentially vertically on the rear of the domestic appliance. An exemplary embodiment of the invention is described in more detail below, with reference to schematic drawings, in which.

DETAILED DESCRIPTION OF THE EXEMPLARY EMBODIMENTS OF THE PRESENT INVENTION

In FIGS. 1 to 8, the same or functionally similar elements are identified by the same reference numbers.

Figure 1:
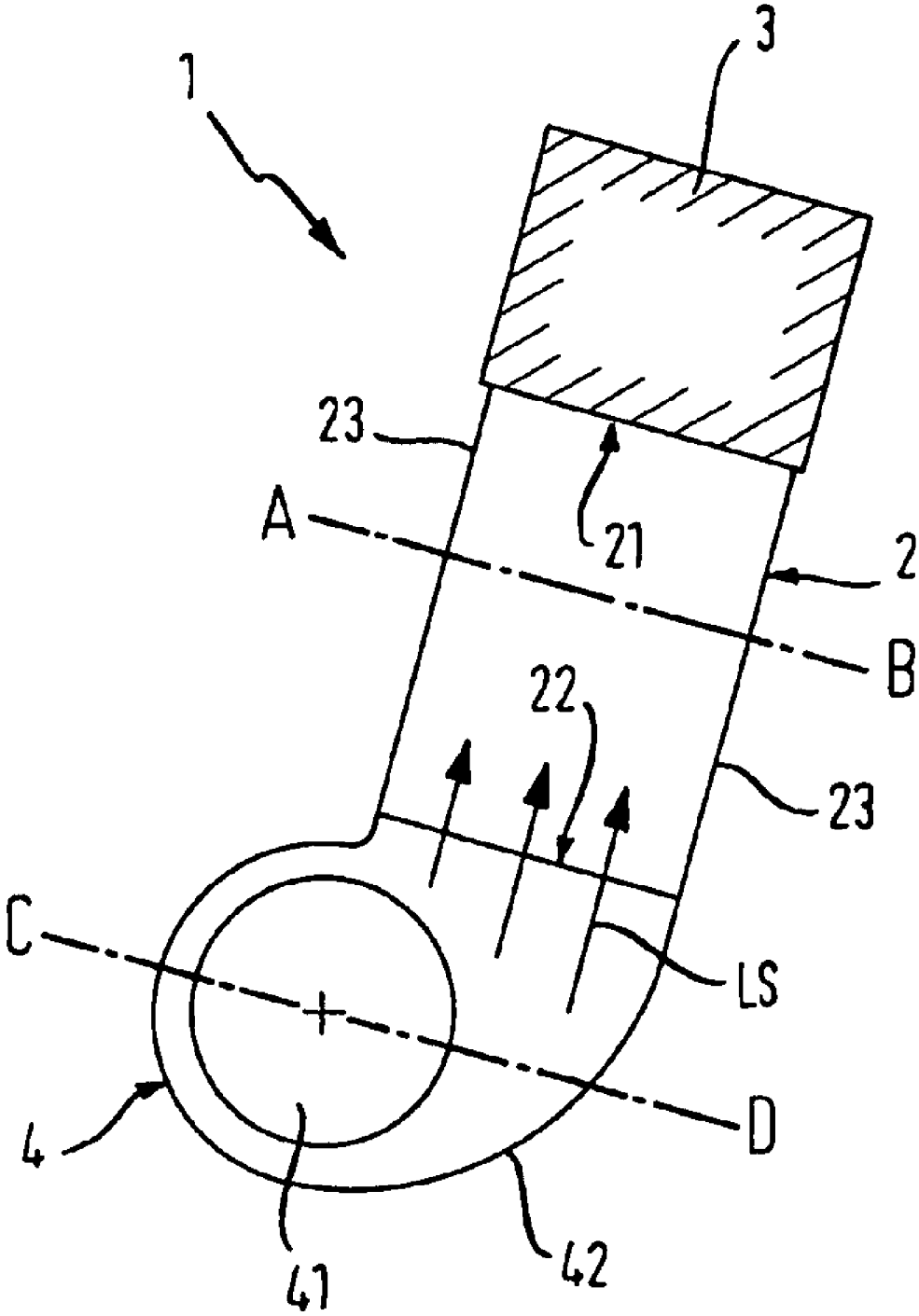
FIG. 1 shows a rear view of a clothes dryer known from the prior art.

FIG. 1 shows, in diagrammatic form, a rear view of a known clothes dryer 1. As may be seen, the clothes dryer 1 has an air conveying device 2 with a flow channel 20 (FIG. 2), which has a first open end area 21 and a second open end area 22. The first open end area 21 is connected to a heating device 3, with the open end area 21 opening into the heating device 3. A fan mechanism 4 is connected to the second open end area 22. The fan mechanism 4 has a fan wheel 41, which is arranged in a housing 42. The housing 42 has an opening which opens into the second open end area 22 of the flow channel 20. As can be seen in the representation in FIG. 1, the flow channel 20 has two guide plates 23 in its peripheral area, by means of which the flow channel 20 is laterally delimited.

As can further be seen from the representation in FIG. 1, an airflow LS in the direction of the heating device 3 is generated by the fan wheel 41, with the airflow LS being transported through the flow channel 20.

Figure 2:
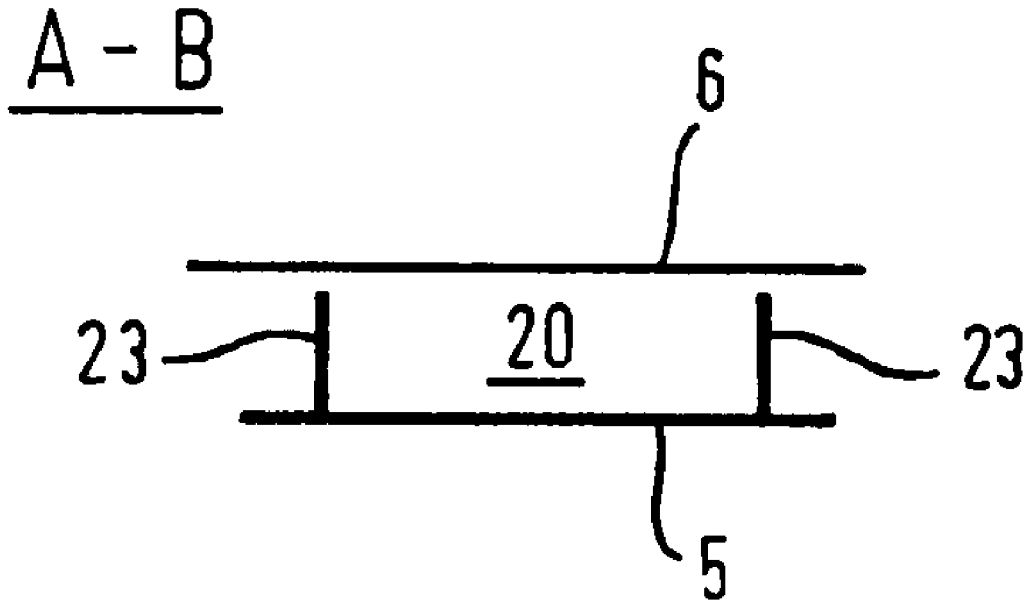
FIG. 2 shows a first cross-sectional representation along the section line A-B of the known clothes dryer according to FIG. 1.

FIG. 2 shows a cross-sectional representation along the section line A-B according to FIG. 1. As can be seen here, the guide plates 23 laterally delimiting the flow channel 20 are essentially oriented parallel to each other, and arranged on a wall area 5 of the rear of the clothes dryer 1. As can be clearly discerned from the representation in FIG. 2, a cover 6 is arranged on the opposite side of the wall area 5, at a distance from these two guide plates 23. A free space is thus embodied between the guide plates 23 and the cover 6, through which free space the air can flow laterally and unhindered out of the flow channel 20 or, as the case may be, into the flow channel 20. This can give rise to considerable levels of noise, as well as high energy consumption in the clothes dryer 1. Furthermore, relatively lengthy drying times result from the seriously inadequate transport of the stream of air LS in the open flow channel 20.

Figure 3:
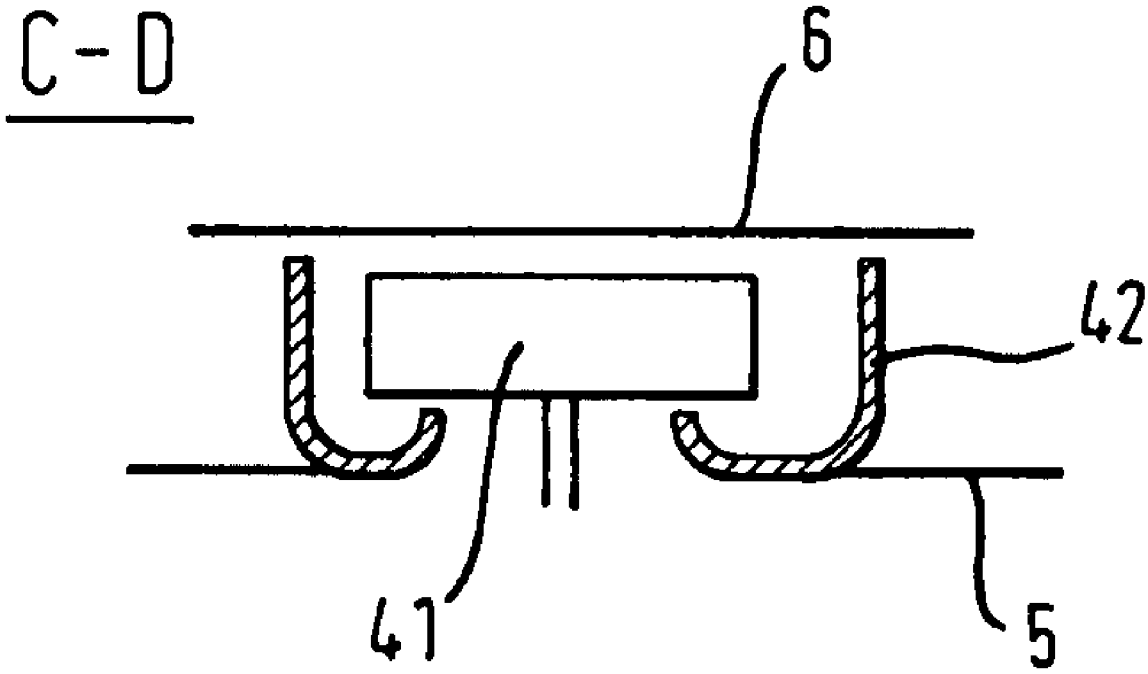
FIG. 3 shows a second cross-sectional representation along the section line C-D of the clothes dryer known from the prior art according to FIG. 1.

A further cross-sectional representation along the section line C-D according to FIG. 1 is shown in the representation in FIG. 3. This cross-sectional representation is shown in the area of the fan mechanism 4. As can be seen here, the fan wheel 41 is arranged in the housing 42. Here too it can be clearly seen that the peripheral area of the housing 42 which faces the cover 6 is arranged at a distance from said cover 6. The open embodiment of the fan mechanism 4 results inter alia in a relatively poor insulation property.

Figure 4:
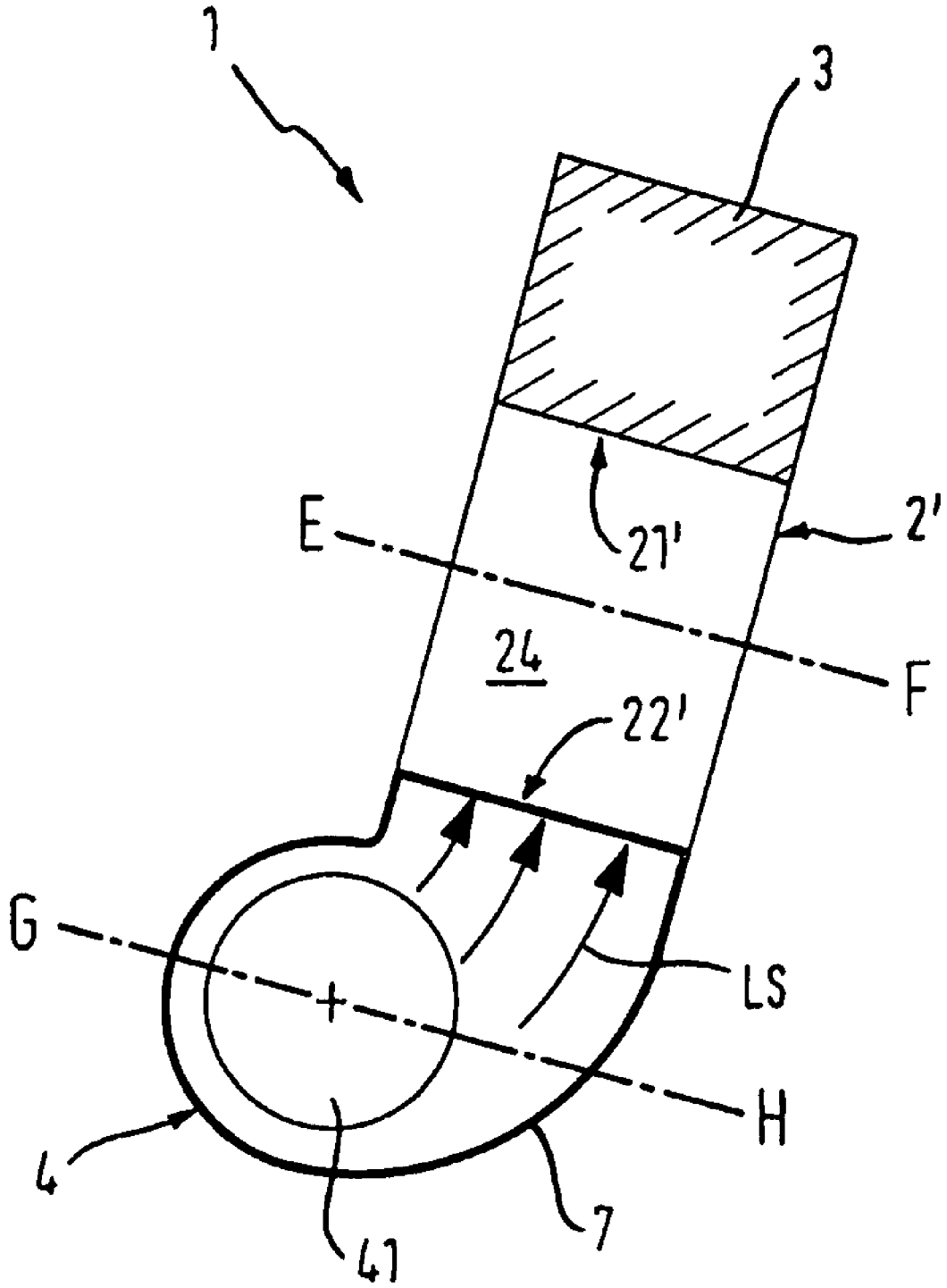
FIG. 4 shows a diagrammatic representation of a rear view of an inventive domestic appliance for the care of laundry items.

FIG. 4 shows a diagrammatic view of a rear of an inventive domestic appliance for the care of laundry items which in the exemplary embodiment is embodied as a clothes dryer 1. In the case of the inventive clothes dryer 1, the fan mechanism 2' has a closed flow channel 20' which, according to the invention, is only embodied in two parts. The closed flow channel 20' is formed here from the wall area 5 of the rear of the clothes dryer 1 and an element 24 embodied with a U-shaped cross section. The inventive clothes dryer 1 further has a seal 7 in the region of the fan mechanism 4, said seal being arranged between the housing 42 of the fan mechanism 4 and the cover 6' in such a way that a free space between the peripheral area of the housing 42 facing the cover 6' and the inner wall of the cover 6' is sealed.

Figure 5:
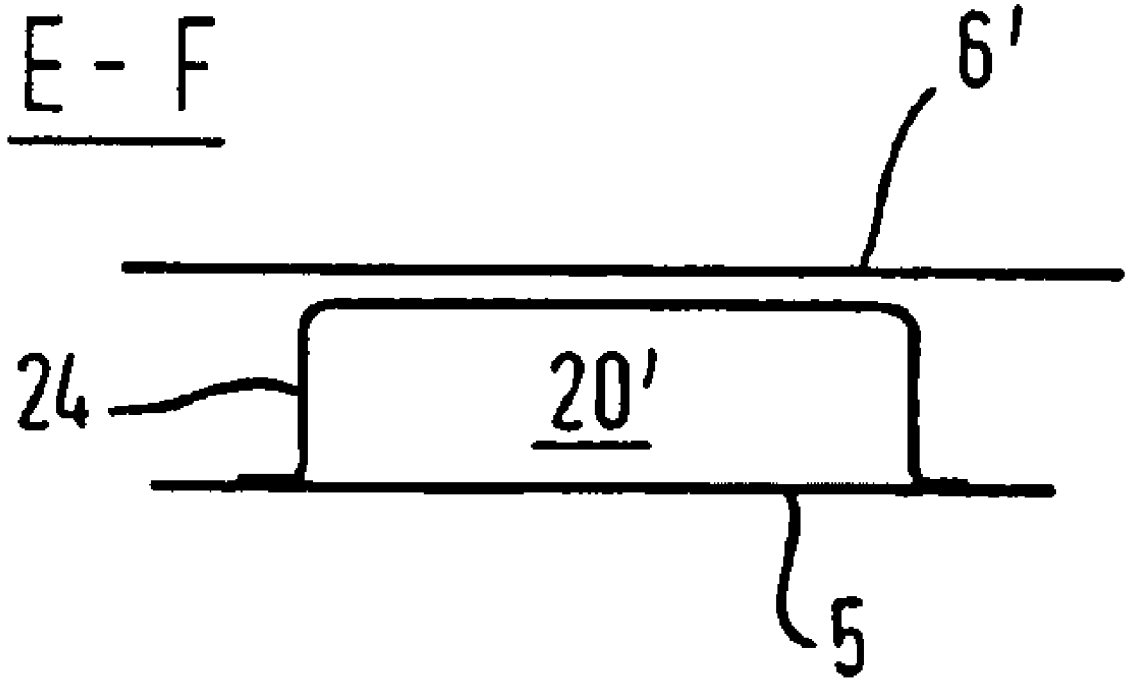
FIG. 5 shows a first cross-sectional representation along the section line E-F of the inventive domestic appliance according to FIG. 4.

FIG. 5 shows a first cross-sectional representation along the section line E-F of the inventive clothes dryer 1 according to FIG. 4. The cross-sectional representation is here shown, as can be discerned in FIG. 4, in the area of the fan mechanism 2'. The closed flow channel 20' has a completely closed cross section, and has openings only in the two end areas 21' and 22'. The U-shaped element 24 is arranged here in such a way that it is permanently arranged with its open area in the wall area 5 of the rear of the clothes dryer 1. To this end, screw connections, bolt connections, welded connections or suchlike can be provided. As can be further seen from FIG. 5, the cover 6' is arranged at a distance from the U-shaped element 24, in particular from the bottom leg of the U-shaped element 24. The closed flow channel 20' is thus effectively embodied in double-walled form on the side facing away from the clothes dryer 1, or, on the side in the wall area 5 facing away from the rear of the clothes dryer 1. This double-walled configuration is formed by the U-shaped element 24 and the cover 6' arranged above this.

Figure 6:
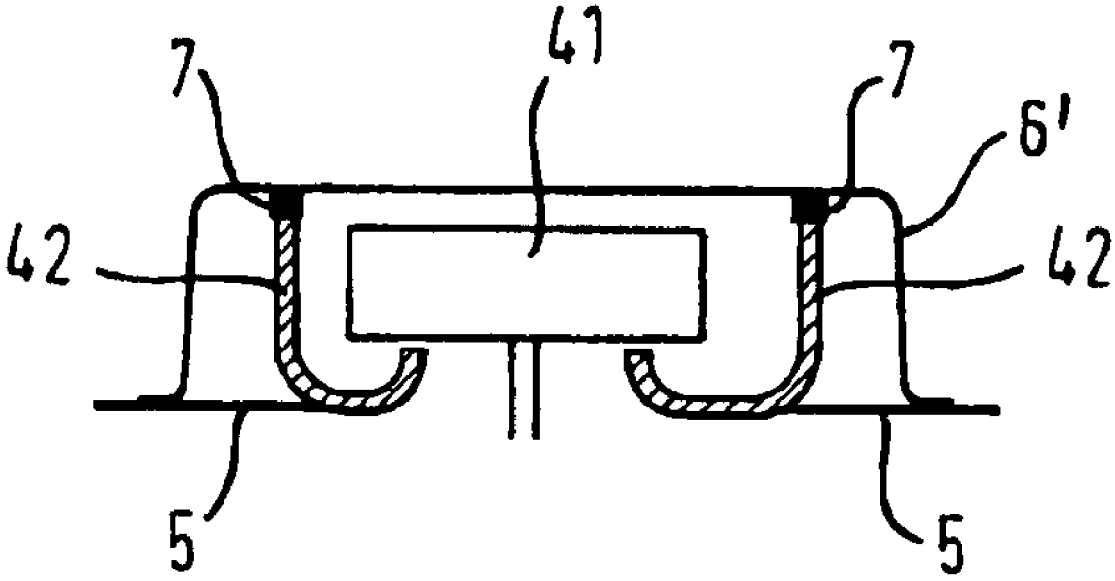
FIG. 6 shows a second cross-sectional representation along the section line G-H of the inventive domestic appliance according to FIG. 4.

A second cross-sectional representation along the section line G-H according to FIG. 4 is shown in FIG. 6. As can be seen here, the seal 7 is located between the housing 42 of the fan mechanism 4 and the cover 6'. This seal 7 can be glued here to the peripheral areas of the housing 42 facing towards the cover 6' and/or to the internal face of the cover 6'.

As can be seen from the representation shown in FIGS. 4 to 6, an air conveying device 2' is thus embodied between the heating device 3 and the fan mechanism 4, which has a flow channel 20' that is completely closed except for the open end areas 21' and 22'.

Figure 7:
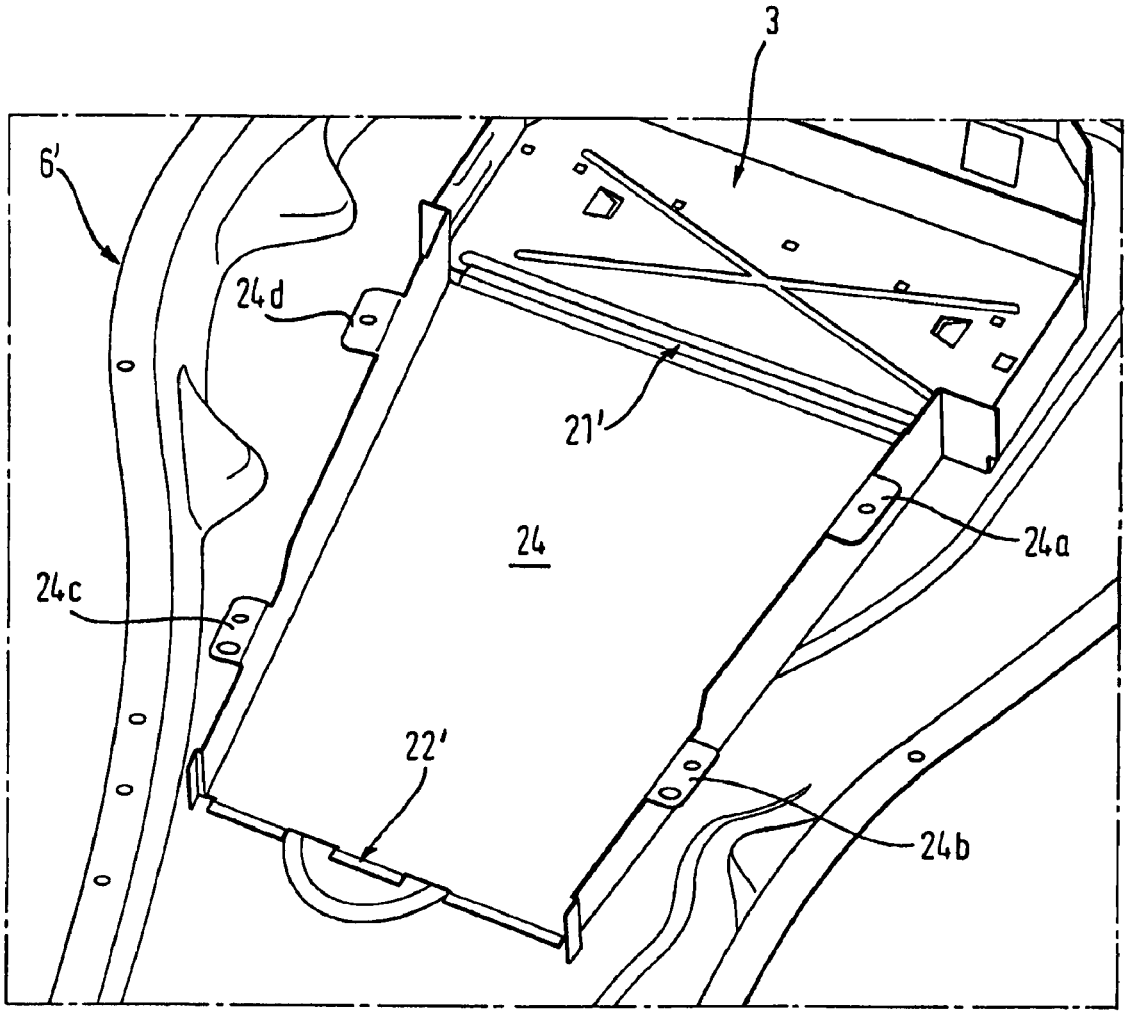
FIG. 7 shows a perspective view of a partial area of the inventive domestic appliance.

A perspective representation of a partial area of the inventive clothes dryer 1 is shown in FIG. 7. This perspective representation shows a view from the interior of the clothes dryer 1 outwards. As can be seen from this, the wall area 5 (FIG. 5) is not represented, so that it is possible to see into the interior area of the U-shaped element 24, which forms part of the closed flow channel 20'. As can further be discerned from FIG. 7, the first open end area 21' opens into the heating device 3. The second open end area 22', as already explained in relation to FIG. 4, opens into an opening in the housing 42 of the fan mechanism 4. This fan mechanism 4 is, however, not shown in FIG. 7. The U-shaped element 24 has on its side legs fixing areas **24*a* to 24*d*, which serve to attach the U-shaped element 24 to the wall area 5, which is not shown, by means of screws for instance. It is further possible to discern that the cover 6' in the exemplary embodiment is embodied in such a way that it covers both the heating device 3, the air conveying device 2' with the closed flow channel 20' and the fan mechanism 4**.

Figure 8:
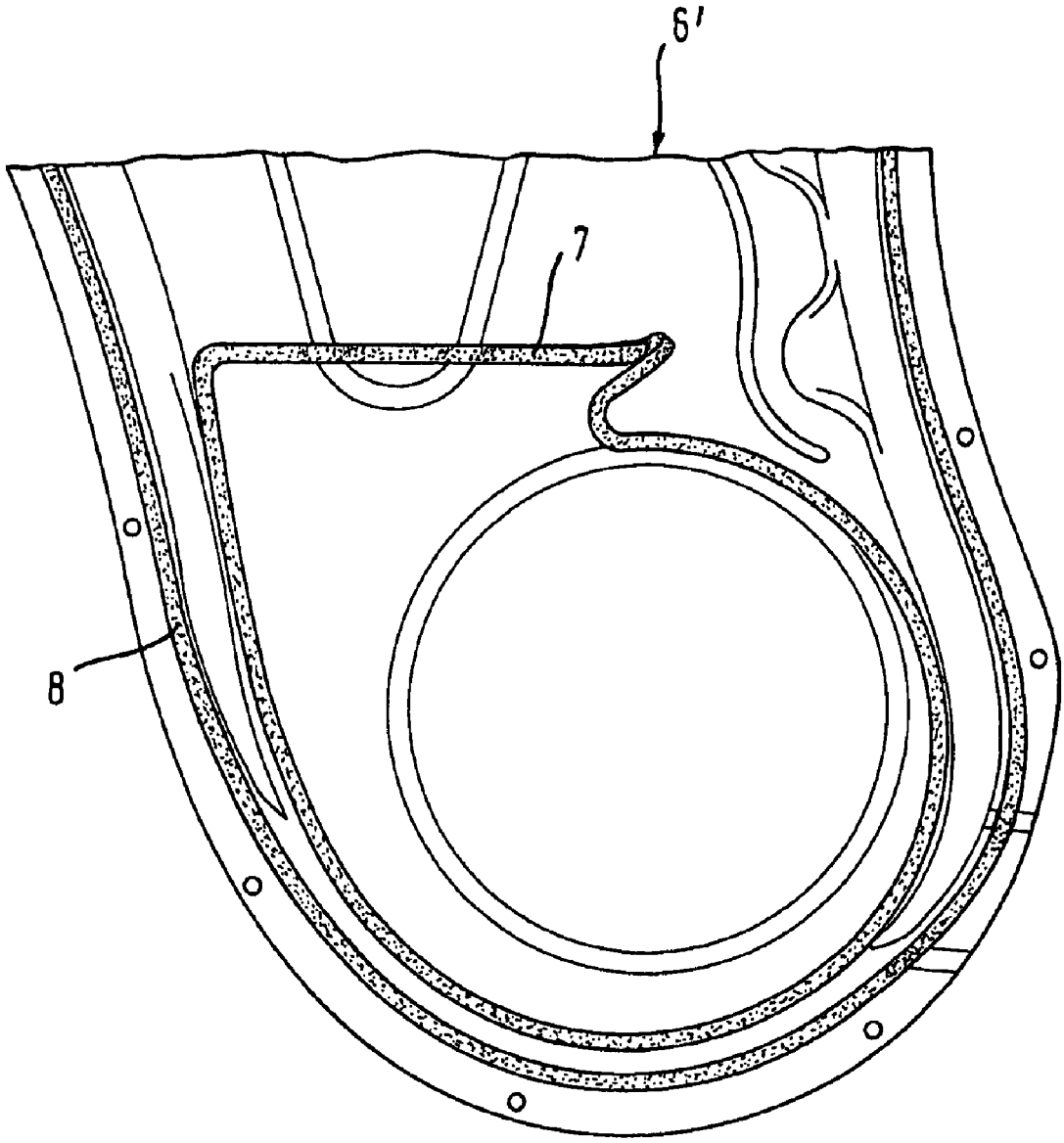
FIG. 8 shows a perspective representation of a partial area of a cover of the inventive domestic appliance.

FIG. 8 shows a further perspective representation which represents the cover 6' in a lower area, and thus in the area in which it covers the fan mechanism 4.

As can be seen here, the seal 7 is arranged, and in particular glued on the inner surface of the cover 6'. It may further be seen that a further seal 8 is arranged on the peripheral area of the cover 6', with this seal 8 being arranged completely surrounding the peripheral area of the cover 6', and in particular likewise glued in place. This seal 8 is thus arranged between the cover 6' and the wall area 5 of the rear of the clothes dryer 1. This seal 8 is not illustrated in the cross-sectional representations shown in FIG. 5 and FIG. 6.

In the embodiments represented, the U-shaped element 24, the wall area 5 and the cover 6' are embodied as metal plates. Provision can also be made for at least one of the abovementioned elements to be embodied in a different material, such as plastic for instance. The elements can also be manufactured from a material which effects a further reduction in the development of noise during operation of the inventive domestic appliance and/or an improvement in the insulation.

The invention claimed is:

1. An appliance for handling laundry items, in particular a clothes dryer, the appliance comprising:

means forming a laundry item handling area in which laundry items to be handled are received;

a housing in which the means forming a laundry handling area is located, the housing including a back side wall forming at least a portion of a back side of the appliance;

an air conveying device mounted adjacent to an exterior surface of the back side wall, the air conveying device having a first open end area communicated with a heating device and a second open end area communicated with a housing of a fan assembly and the air conveying device having a flow channel that is cross-sectionally closed such that the flow channel is self-contained;

a cover that covers the housing of the fan assembly and the flow channel, wherein the flow channel is disposed between the exterior surface of the back side wall and the cover; and a sealing element disposed between the housing of the fan assembly and the cover.

2. The appliance as claimed in claim 1, wherein the flow channel is formed by two parts with one of the parts being the back side wall that faces an exterior of the appliance and the other of the parts being an element having a U-shaped cross section and mounted on the back side wall.

3. The appliance as claimed in claim 1, wherein the sealing element is mounted on one of a peripheral area of the housing and the cover.

4. The appliance as claimed in claim 1, wherein the first open end area and the second open end area of the air conveying device are located opposite to each other and the flow channel is oriented essentially vertically.

5. An appliance for handling laundry items, in particular a clothes dryer, the appliance comprising:

means forming a laundry item handling area in which laundry items to be handled are received;

a housing in which the means forming a laundry handling area is located, the housing including a back side wall forming at least a portion of a back side of the appliance;

an air conveying device mounted adjacent the back side wall, the air conveying device having a first open end area communicated with a heating device and a second open end area communicated with a housing of a fan assembly and the air conveying device having a flow channel that is cross-sectionally closed such that the flow channel is self-contained;

a cover that covers the housing of the fan assembly and the flow channel; and a sealing element disposed between the housing of the fan assembly and the cover, wherein the sealing element is mounted on a peripheral area of the housing and facing the cover.

6. The appliance as claimed in claim 5, wherein the sealing element completely surrounds a peripheral area of the housing.

7. An appliance for handling laundry items, in particular a clothes dryer, the appliance comprising:

means forming a laundry item handling area in which laundry items to be handled are received;

a housing in which the means forming a laundry handling area is located, the housing including a back side wall forming at least a portion of a back side of the appliance;

an air conveying device mounted adjacent the back side wall, the air conveying device having a first open end area communicated with a heating device and a second open end area communicated with a housing of a fan assembly and the air conveying device having a flow channel that is cross-sectionally closed such that the flow channel is self-contained;

a cover that covers the housing of the fan assembly and the flow channel; and a sealing element disposed between the housing of the fan assembly and the cover, wherein the sealing element is mounted on a peripheral area of the cover and facing the housing.

8. The appliance as claimed in claim 7, wherein the sealing element completely surrounds a peripheral area of the cover.

9. An appliance for handling laundry items, in particular a clothes dryer, the appliance comprising:

means forming a laundry item handling area in which laundry items to be handled are received;

a housing in which the means forming a laundry handling area is located, the housing including a back side wall forming at least a portion of a back side of the appliance;

an air conveying device mounted adjacent the back side wall, the air conveying device having a first open end area communicated with a heating device and a second open end area communicated with a housing of a fan assembly and the air conveying device having a flow channel that is cross-sectionally closed such that the flow channel is self-contained;

a cover that covers the housing of the fan assembly and the flow channel;

a sealing element disposed between the housing of the fan assembly and the cover; and a second sealing element disposed between the cover and the back side wall.

10. The appliance of claim 9, wherein the second sealing element completely surrounds a peripheral area of the cover.

11. The appliance as claimed in claim 9, wherein the second sealing element is mounted on the back side wall and facing the cover.

12. The appliance as claimed in claim 9, wherein the sealing element is mounted on a peripheral area of the cover and facing the back side wall.

13. A clothes dryer for handling laundry items, the clothes dryer comprising:

a laundry item handling area in which laundry items to be handled are received;

a housing in which the laundry handling area is located, wherein the housing includes:

a heating device;

a housing of a fan assembly;

a back side wall forming at least a portion of a back side of the appliance;

an air conveying device mounted adjacent to an exterior surface of the back side wall, the air conveying device including a flow channel that is completely cross-sectionally closed except for a first open end and a second open end such that the flow channel is self-contained, wherein the first open end is coupled to the heating device and the second open end is coupled to the housing of the fan assembly, a cover that covers the housing of the fan assembly and the flow channel, wherein the flow channel is disposed between the exterior surface of the back side wall and the cover; and a first sealing element disposed between the housing of the fan assembly and the cover.

14. The clothes dryer of claim 13, wherein the flow channel is formed by two parts with one of the parts being the back side wall that faces an exterior of the domestic appliance and the other of the parts being an element having a U-shaped cross section and mounted on the back side wall.

15. The clothes dryer of claim 13, wherein the first sealing element is mounted on a peripheral area of the housing and facing the cover.

16. The clothes dryer of claim 15, wherein the first sealing element completely surrounds a peripheral area of the housing.

17. The clothes dryer of claim 13, wherein the first sealing element is mounted on a peripheral area of the cover and facing the housing.

18. The clothes dryer of claim 17, wherein the first sealing element completely surrounds a peripheral area of the cover.

19. The clothes dryer of claim 13, wherein the first open end area and the second open end area of the air conveying device are located opposite to each other and the flow channel is oriented vertically along the back side wall of the back side of the appliance.

20. The clothes dryer of claim 13, comprising:

a second sealing element disposed between the cover and the back side wall.

21. The clothes dryer of claim 20, wherein the second sealing element completely surrounds a peripheral area of the cover.

22. The clothes dryer of claim 20, wherein the second sealing element is mounted on the back side wall and facing the cover.

23. The clothes dryer of claim 20, wherein the sealing element is mounted on a peripheral area of the cover and facing the back side wall.

24. The appliance as claimed in claim 1, wherein the flow channel is disposed entirely between the exterior surface of the back side wall and the cover.

25. The clothes dryer of claim 13, wherein the flow channel is disposed entirely between the exterior surface of the back side wall and the cover.

* * * * *